US005105398A

United States Patent [19]

Hayakawa et al.

[11] Patent Number: 5,105,398

[45] Date of Patent: Apr. 14, 1992

[54] THREE HANDS TYPE CLOCK WITH BELT DRIVE

[75] Inventors: Tsuyoshi Hayakawa; Satoru Yamauchi; Junichi Aizawa; Yukio Funahara, all of Tokyo, Japan

[73] Assignee: Seikosha Co., Ltd., Japan

[21] Appl. No.: 689,719

[22] Filed: Apr. 22, 1991

Related U.S. Application Data

[63] Continuation of Ser. No. 248,365, Sep. 23, 1988, abandoned.

[30] Foreign Application Priority Data

Sep. 25, 1987 [JP] Japan ..... 62-241397
Aug. 27, 1988 [JP] Japan ..... 63-112254

[51] Int. Cl.[5] ..... G04B 19/04; G04C 19/02

[52] U.S. Cl. ..... 368/238; 368/80; 368/223; 368/276; 368/77; 368/220

[58] Field of Search ..... 368/223, 228, 238, 221, 368/222, 276, 25, 40, 77, 50

[56] References Cited

U.S. PATENT DOCUMENTS 1,676,030 7/1928 Helin .
3,956,879 5/1976 Bailey .
4,034,549 7/1977 Danley et al. ..... 368/240
4,103,484 8/1978 Bailey .
4,128,949 12/1978 Marason, Jr. et al. ..... 368/45
4,280,211 7/1981 Mayenschein .

*Primary Examiner*—Bernard Roskoski
*Attorney, Agent, or Firm*—Bruce L. Adams; Van C. Wilks

[57] ABSTRACT

A three-handed clock has a single movement to rotationally drive the second, minute and hour hands. The rotary output of the movement is transmitted directly to the second hand and is transmitted through a transmission belt to the minute and hour hands. The use of the transmission belt eliminates the need for a gear train to drive the minute and hour hands thereby providing greater design flexibility and ease of assembly and maintenance.

3 Claims, 5 Drawing Sheets

THREE HANDS TYPE CLOCK WITH BELT DRIVE

This is a continuation application of Ser. No. 248,365 filed Sep. 23, 1988 now abandoned.

BACKGROUND OF THE INVENTION

The present invention relates to a structure of a three hands type clock in which a second hand shaft which carries a second hand and is disposed separately relative to hour and minute hand shafts which respectively carry, hour and minute hands.

A three hand type wristwatch in which a second hand shaft which carries a second hand and is disposed separately relative to hour and minute hand shafts which respectively carry hour and minute hands, has heretofore been constructed such that the hour and minute hands are disposed separately from the second hand on the same dial, and power is transmitted to the hour and minute hands as well as to the second hand through a train wheel structure inside a single watch movement.

There has also been known a similar three hands type wall clock in which hour and minute hands and a second hand are disposed in two different locations on the same dial, and separate clocks movements are provided for driving the hour and minute hands and the second hand, respectively.

However, in the former structure in which the hour and minute hands and the second hand are disposed in two different locations and are operated with the train wheel structure inside the single watch movement, the number of elements of the train wheel is necessarily increased, thereby resulting in the problems of increased cost and deteriorated reliability due to the greater number of parts. Further, because the mutual positional relationship between the two indication portions is determined by the train wheel, there is another problem of limiting the degree of freedom in clock design.

In the latter structure in which the hour and minute hands and the second hand are associated with separate movements for driving the corresponding hands, the two indication portions are free from the limitation in the mutual positional relationship, so the degree of freedom in clock design is improved. However, there are problems that cost is increased due to the need of using two clock movements, and a discrepancy may occur in time indications because of difference in basic frequencies of quartz crystals between the two movements.

SUMMARY OF THE INVENTION

It is, therefore, an object of the present invention to provide a structure of a three hands type timepiece, such as a clock, in which the spacing between the position of the hour and minute hands and the position of a second hand can freely be adjusted in the process of design, and the problem of cost is alleviated.

The present invention is characterized by the following features: a movement for driving a second hand shaft is provided with a first rotating wheel driven by the movement;

hour and minute hand shafts are respectively provided with an hour hand gear and a minute hand pinion which operatively interlock through a minute wheel; and a transmission belt is provided between the first rotating wheel and a second rotating wheel interlocked to the minute hand shaft.

BRIEF DESCRIPTION OF THE DRAWINGS

The drawings illustrate embodiments of the present invention in which.

DETAILED DESCRIPTION OF INVENTION

Figure 1:
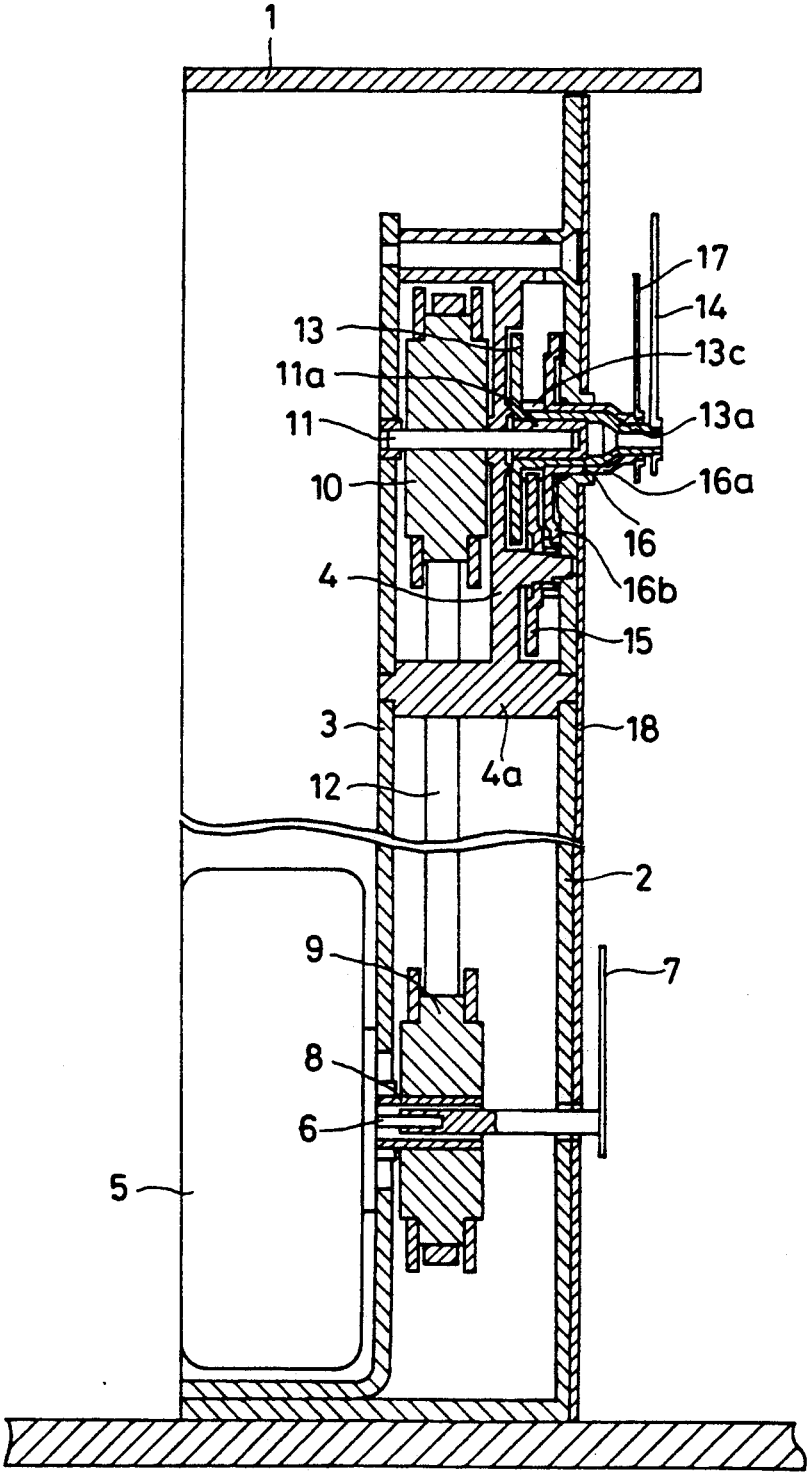
FIG. 1 is an enlarged sectional view taken along the line I—I in FIG. 2, of one embodiment.
Figure 2:
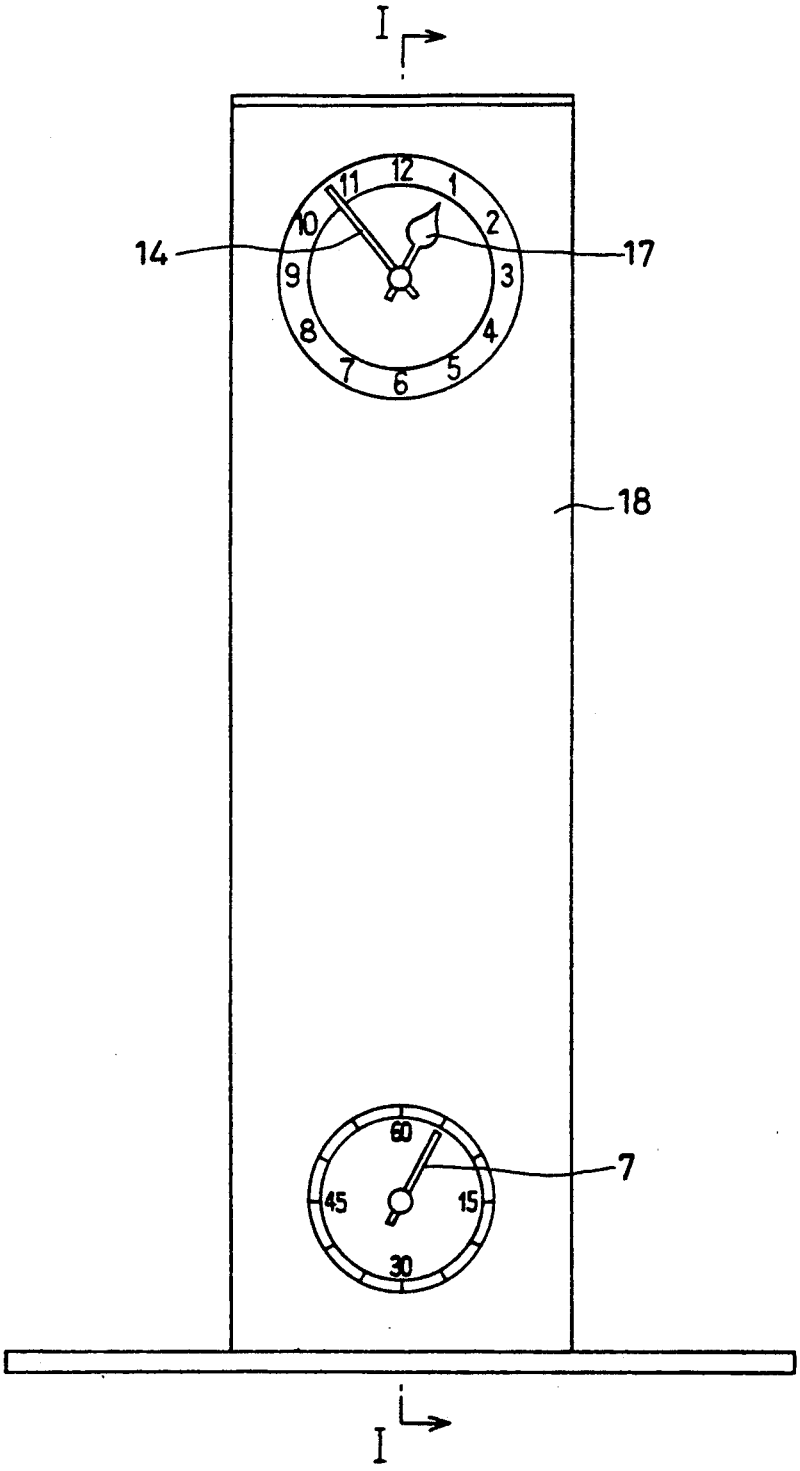
FIG. 2 is a front view.

Embodiments of the present invention will be described below with reference to the drawings. In FIG. 1, a front frame (dial receiver) 2 and a rear frame 3 are oppositely disposed within an outer peripheral frame 1 with a certain spacing therebetween as determined by a support post portion 4*a* provided integrally with an intermediate frame 4.

A clock movement 5 is fixed to the back surface of the rear frame 3, and a second hand 7 is fixed to the distal end of a second hand shaft 6 rotatively driven by the movement 5. A gear 9 comprising a first rotating wheel is fixedly fitted over a shaft 8 corresponding to a minute hand shaft rotatively driven by the movement 5 at a reduced speed. At a position spaced through a certain distance above a gear 9, another gear 10 as comprising a second rotating wheel is fixedly fitted over a shaft 11 journalled to the rear frame 3 and the intermediate plate 4. Accordingly, the gear 10 is interlocked to rotate at the same speed as the gear 9 through a transmission belt 12.

A minute hand wheel 13 is fixed through a bushing 11*a* to the shaft 11 interlocked with the gear 10. The minute hand wheel 13 has a minute hand shaft 13*a*, and a minute hand 14 is fixed to the minute hand shaft 13*a*. A minute wheel 15 is in mesh with a minute hand pinion 13*c* formed on the minute hand wheel 13, and an hour hand gear 16*b* is in mesh with the minute wheel 15, the hour hand gear 16*b* being formed on an hour hand shaft 16*a* of an hour hand wheel 16 mounted coaxially with the minute hand wheel. An hour hand 17 is fixed to the hand gear. It is a matter of course that the second hand 7, the minute hand 14 and the hour hand 17 are positioned over the front surface of a dial 18 bonded to the front frame 2.

Thus, the second hand 7 is rotatively driven by the clock movement 5 for second indication. The torque of the gear 9 fixedly fitted over the shaft corresponding to the minute hand shaft is transmitted to the gear 10 through the transmission belt 12 for minute indication by the minute hand 14, whereas the torque is transmitted from the minute hand wheel 13 to the hour hand wheel 16, while being reduced in speed through the minute wheel 15, for hour indication by the hour hand 17.

Another embodiment will be described below.

Figure 3:
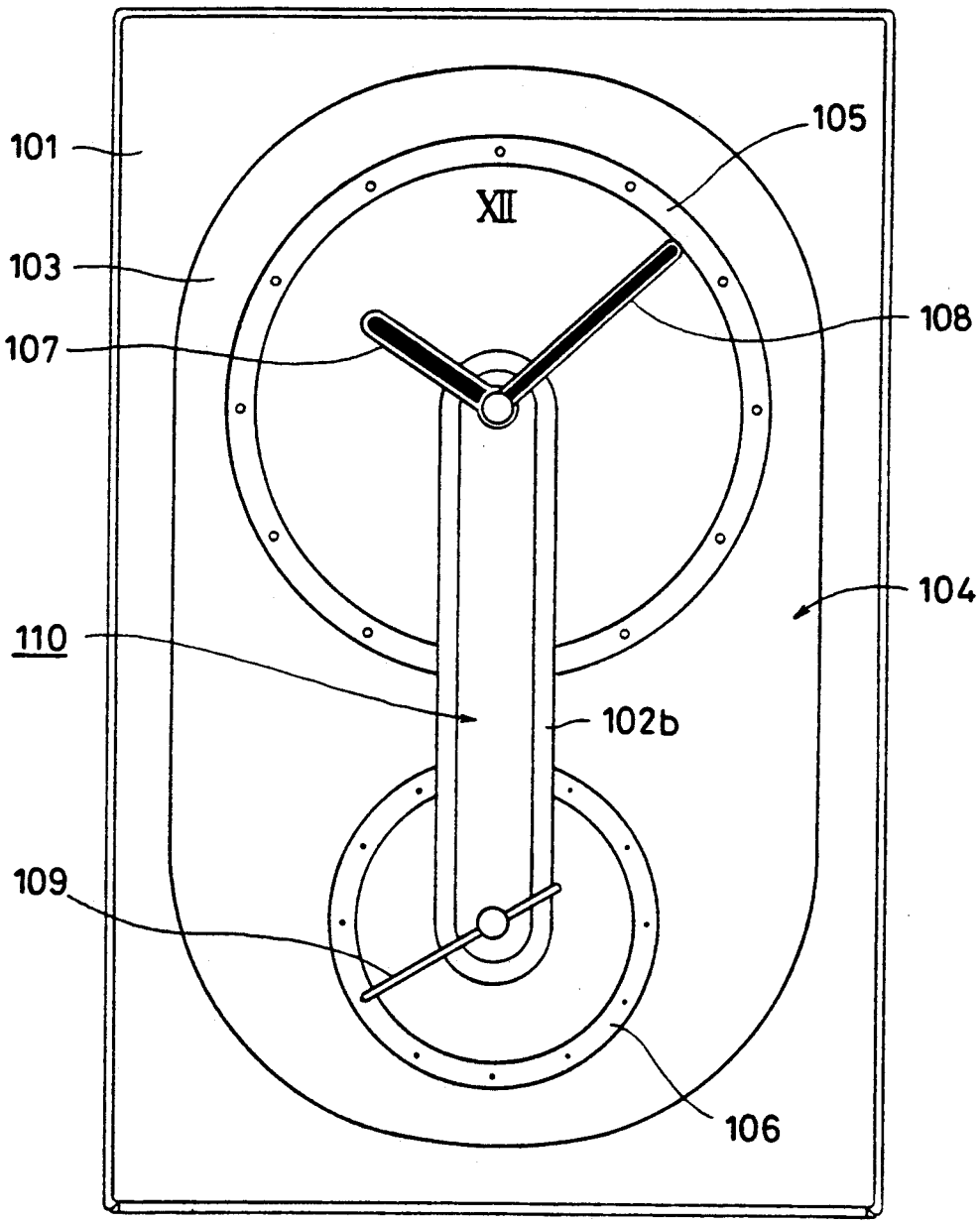
FIG. 3 is a front view showing another embodiment.
Figure 4:
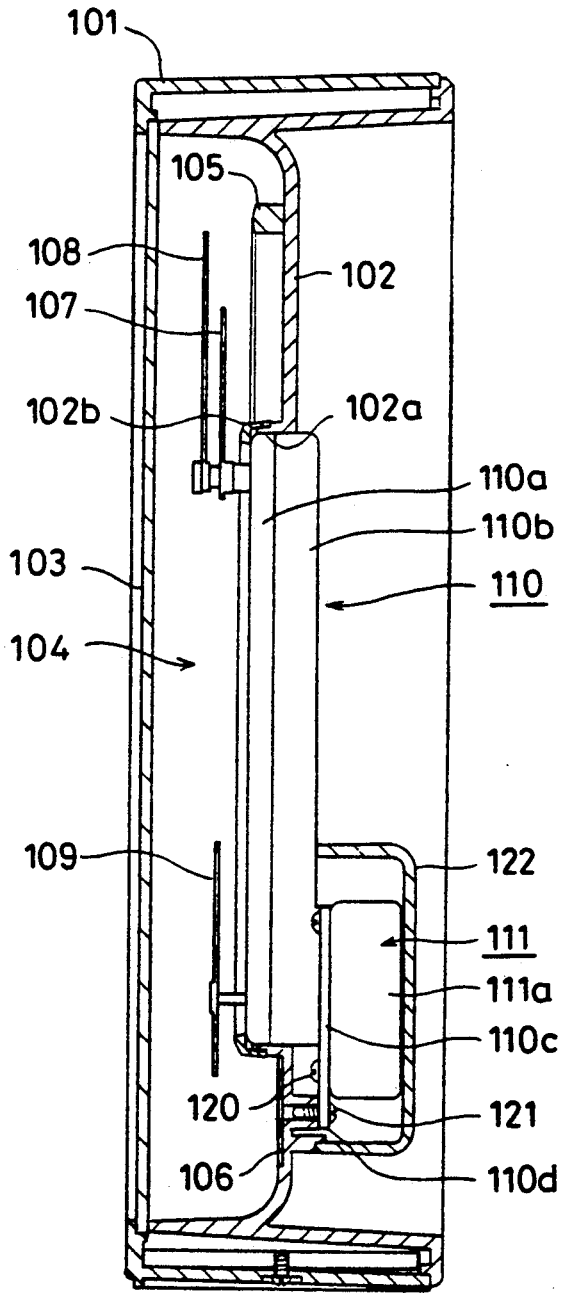
FIG. 4 is a vertical sectional view of FIG. 3.

As shown in FIGS. 3 and 4, a front cover 103 is held between a front frame 101 and a rear frame 102 so that a time-indicating section 104 is defined between the front cover 103 and the rear frame 102. A ring-like dial 105 containing time indicia for hour and minute hands 107 and 108 is disposed in the upper portion of the time-indicating section 104, and another dial 106 containing time indicia for a second hand 109 is disposed in the lower position thereof spaced from the dial 105. The hour hand 107 and minute hand 108 driven by a drive mechanism (described later) are provided forwardly at the center of the dial 106 in a rotatable manner, whereas the second hand 109 is provided forwardly at the center of the dial 106 in a rotatable manner too. The second hand 109 is driven by a movement 111, and a transmission unit 110 for driving the hour hand 107 and the minute hand 108 by the movement 111 is constructed as described later. The transmission unit 110 is encased within an elongate auxiliary case comprised of front and rear cases 110*a* and 110*b*, and the auxiliary case is fitted in a tubular portion 102*a* disposed in the rear frame 102, and an ornament 102*b* is attached to the front edge of the tubular portion 102*a*.

Figure 5:
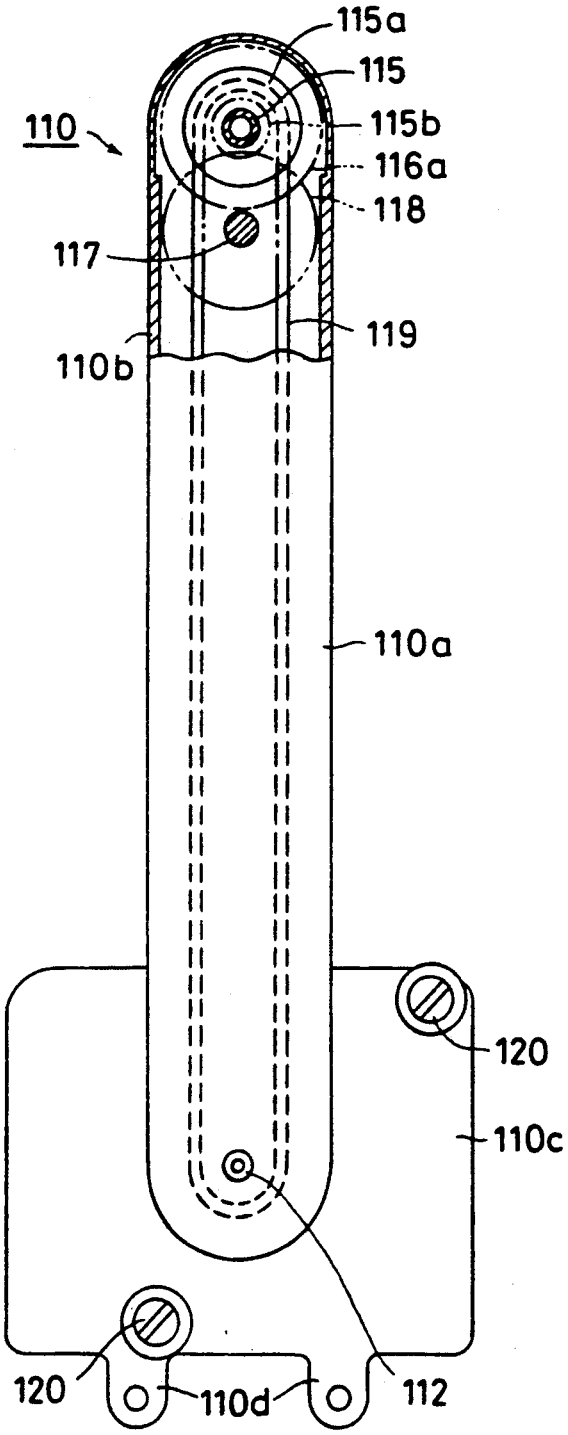
FIG. 5 is an enlarged front view, partly sectioned, of an essential part.
Figure 6:
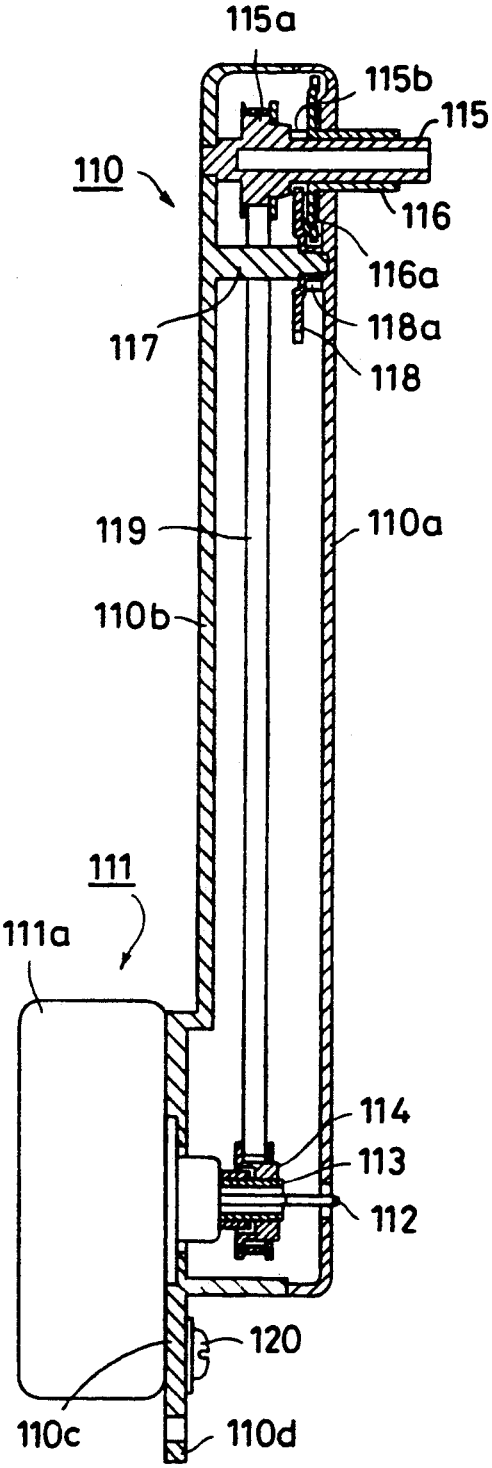
FIG. 6 is a side view, partly sectioned, of FIG. 5.

As shown in FIGS. 5 and 6, the rear case 100*b* of the transmission unit 110 is connected to the front surface of a movement case 111*a* of the movement 111. In this embodiment, the front case 110*a* and the rear case 110*a* and the rear case 110*b* are disposed opposite to each other, and a second hand shaft 112 and a drive shaft 113 both driven by the movement 111 project into the rear case 110*b*. The distal end of the second hand shaft 112 further projects forward through the front case 110*a*, and the second hand 109 is fitted over the projected distal end of the second hand shaft 112. The drive shaft 113, over which a minute hand has been fitted, is rotatively driven by the second hand shaft 112 at a reduced speed, and a belt wheel 114 comprising a first rotating wheel is fixedly fitted over the drive shaft 113. At a position spaced through a certain distance above the belt wheel 114, another belt wheel 115*a* comprising a second rotating wheel is formed integrally with a minute hand shaft 115. The minute hand shaft 115 is rotatably supported on the lower case 110*b*, and a minute hand pinion 115*b* is formed integrally on the minute hand shaft 115. An hour hand gear 116*a* is integrally formed with the hour hand shaft 116 rotatably fitted over the minute hand shaft 115.

A shaft 117 is disposed to project forward from the rear case 110*b*, and a minute wheel 118 is rotatably fitted over the shaft 117. The minute wheel 118 is in mesh with the minute hand pinion 115*b* and a minute pinion 118*a* is in mesh with the hour hand gear 116*a*, thereby jointly constituting a train wheel for reduction speed. A transmission belt 119 extends between the first rotating wheel 114 and the second rotating wheel 115*a*, so that the the minute hand shaft 115 is driven at the same rotational speed as the drive shaft 113, i.e., at a rotational speed with which the minute hand shaft 115 is rotated once per 60 minutes.

The minute hand shaft 115 and the hour hand shaft 116 have their distal ends projecting forward through the front case 110*a*, with the minute hand 108 and the hour hand 107 fitted over the respective projected distal ends.

The rear case 110*b* has its lower end portion serving as a connecting portion 110*c* which is positioned in contact with the front surface of the case 111*a* for the movement 111. The auxiliary case 110*a*, 110*b* is connected to the movement 111 by means of screws 120 penetrating through the connecting portion 110*c*. The rear case 110*b* also has extending portion 110*d* extending downward from the connecting portion 110*c* and, as shown in FIG. 4, both the transmission unit 110 and the movement 111 are fixed together to the rear frame 102 by means of set screws 121 penetrating through the extending portion 110*d*. A movement cover 122 for covering the movement 111 is connected to the rear frame 102.

The second hand 109 is rotatively driven by the movement 111 for second indication. The torque of the first rotating wheel 114, fixedly fitted over the drive shaft 113 rotatively driven by power of the movement 111, is transmitted through the transmission belt 119 to the second rotating wheel 115*a* that is integral with the minute hand shaft 115 spaced from the second hand shaft 112, for minute indication by the minute hand 108. At the same time, the torque is transmitted from the minute hand pinion 115*b* to the hour hand gear 116*a*, while being reduced in speed through the minute wheel 118, for hour indication by the hour hand 107.

With this embodiment, components of the mechanism for transmitting power from the movement to the minute and hour hands are housed together in the upper and lower cases to constitute the transmission unit which is then connected to the movement, with the result that the construction is simplified and the efficiency of assembly is significantly improved.

The present invention constituted as described above can provide the following effects. While allowing hour and minute time information to be indicated separately from the second time information on the same dial using a single movement, cost is held at a reasonable level, the number of parts used is not increased, and reliability is not deteriorated. In addition, since the second-indicating position and the hour and minute-indicating positions are interlocked through a transmission belt, the spacing between both the time-indicating positions can freely be set to improve the degree of freedom in clock design.

What is claimed is:

1. In a three-hands type clock having a second hand disposed separately relative to minute and hour hands, the improvement comprising:

a movement case containing therein a timepiece movement, and coaxial second and minute shafts connected to be rotationally driven by the timepiece movement as a function of second and minute time units, the second and minute shafts projecting in a forward direction out of the movement case; and an elongate auxiliary case having one end portion thereof connected to the movement case and receiving therein the forwardly projecting portions of the second and minute shafts, the second shaft extending forwardly through the auxiliary case to the outside thereof and having the second hand mounted thereon to undergo rotation therewith, a minute wheel rotatably mounted at the other end portion of the auxiliary case, another minute shaft connected to rotationally drive the minute wheel and extending forwardly through the auxiliary case to the outside thereof and having the minute hand mounted thereon to undergo rotation therewith, a rotatable hour shaft coaxial with the another minute shaft and extending forwardly through the auxiliary case to the outside thereof and having the hour hand mounted thereon to undergo rotation therewith, means interlocking the minute wheel and hour shaft to rotate in timed relation so that the hour shaft rotates as a function of hour time units when the minute wheel is rotationally driven as a function of minute time units, a first pulley wheel connected to be rotationally driven by the minute shaft at the one end portion of the auxiliary case, a second pulley wheel connected to rotationally drive the another minute shaft at the other end portion of the auxiliary case, and a transmission belt entrained around the first and second pulley wheels to transmit the rotation of the minute shaft to the another minute shaft.

2. A three-hands type clock according to claim 1; wherein the means interlocking comprises a gear train.

3. A three-hands type clock according to claim 1; wherein the auxiliary case comprises upper and lower cases connected together to define the auxiliary case, the another minute shaft and hour shaft being located in the upper case and the minute shaft and second shaft being located in the lower case, and the transmission belt extending through both the upper and lower cases.

* * * * *